US007413134B2

(12) United States Patent
Tsuchida

(10) Patent No.: US 7,413,134 B2
(45) Date of Patent: Aug. 19, 2008

(54) TRIGGER TYPE FLUID DISPENSER

(75) Inventor: Haruo Tsuchida, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 361 days.

(21) Appl. No.: 10/501,861

(22) PCT Filed: Apr. 30, 2003

(86) PCT No.: PCT/JP03/05550

§ 371 (c)(1),
(2), (4) Date: Apr. 11, 2005

(87) PCT Pub. No.: WO03/092906

PCT Pub. Date: Nov. 13, 2003

(65) Prior Publication Data

US 2005/0189381 A1 Sep. 1, 2005

(30) Foreign Application Priority Data

Apr. 30, 2002 (JP) ..... 2002-128712

(51) Int. Cl.
*A62C 11/00* (2006.01)

(52) U.S. Cl. ..... 239/333; 222/383.1; 222/182; 222/341; 239/340

(58) Field of Classification Search ..... 222/183, 222/383.1, 341, 340; 137/843; 239/337, 239/333
See application file for complete search history.

(56) References Cited

U.S. PATENT DOCUMENTS 4,815,663 A * 3/1989 Tada ..... 239/333
4,921,017 A * 5/1990 Tada ..... 137/843
5,156,304 A * 10/1992 Battegazzore ..... 222/341

(Continued)

FOREIGN PATENT DOCUMENTS

JP 10-146546 A 6/1998

(Continued)

*Primary Examiner*—Len Tran
*Assistant Examiner*—Trevor E. McGraw
(74) *Attorney, Agent, or Firm*—Oliff & Berridge, PLC

(57) ABSTRACT

A trigger type fluid dispenser (100) according to the invention includes a body (110) having a discharge flow path (111) and a cylinder (112) disposed in parallel with the discharge flow path (111), and a piston (140) in the cylinder (113) is caused to slide by a trigger (130). The trigger (130) is configured so that a hook portion (131) thereof is held to be swingable by the body (110), a turned-down portion (131) of an extension portion, which is an elastic portion (132) integrally extending from a swinging portion (114) of the hook portion (131), is held with respect to the body (110), and a tip end (132*e*) of the extension portion is positioned to be capable of coming into contact with the hook portion (131). The body (110) is configured so that a cover (120a) is installed to form an internal space (R) between the cover (120) and the discharge flow path (111), and a core element (150) is inserted in the discharge flow path (111) and the internal space (R). The core element (150) is integrally provided with a tongue-shaped element (153), serving as a discharge valve, near a discharge port (111*a*) of the discharge flow path (111), and also integrally provided with a tongue-shaped element (154), serving as a suction valve, in the internal space (R).

11 Claims, 18 Drawing Sheets

U.S. PATENT DOCUMENTS 5,590,834 A * 1/1997 Foster ..... 239/333
5,593,093 A * 1/1997 Foster et al. ..... 239/333
5,706,984 A * 1/1998 Tada et al. ..... 222/182
5,839,621 A * 11/1998 Tada ..... 222/383.1
5,984,149 A * 11/1999 Thanisch et al. ..... 222/340
6,267,271 B1 * 7/2001 Tsuchida et al. ..... 222/383.1
6,364,172 B1 * 4/2002 Maas et al. ..... 222/383.1
6,378,739 B1 * 4/2002 Maas et al. ..... 222/383.1

FOREIGN PATENT DOCUMENTS

JP 11-042452 A 2/1999
JP 2000-024561 A 1/2000
JP 2000-070787 A 3/2000

* cited by examiner

TRIGGER TYPE FLUID DISPENSER

BACKGROUND ART

1. Technical Field

The present invention relates to a trigger type fluid dispenser having a body which is provided with a discharge flow path for discharging a fluid in the horizontal direction and a cylinder disposed under the discharge flow path, a trigger which is held to be swingable with respect to the body, and a piston which slides in the cylinder in cooperation with the trigger.

2. Prior Art

A trigger type fluid dispenser is configured so that the user pulls a trigger with his/her finger to bring about a pumping action, by which a content filled in a container body is discharged. The trigger type fluid dispenser is usually provided with a body which has a discharge flow path for discharging a fluid in the horizontal direction and a cylinder arranged in parallel with the discharge flow path, a trigger which is held to be swingable by a pin provided in the body, and a piston which slides in the cylinder in cooperation with the trigger. The piston brings about a push-in action in the cylinder in cooperation with the pulling operation of the trigger by the contact of the piston with a protrusion provided on the trigger, and brings about a push-back action in the cylinder by an urging force of a return spring disposed in the cylinder when the finger is removed from the trigger.

Moreover, the trigger type fluid dispenser has a discharge valve consisting of an elastic valve which is opened by the push-in action of piston to discharge the fluid in the discharge flow path to the outside, and a suction valve consisting of a ball valve which is opened by the push-back action of piston to suck the fluid into the discharge flow path, and is insertedly provided with an intake having a valve seat common to these valves in the body thereof. The intake has a communicating hole which is in alignment with a communicating hole provided in the cylinder, and is also provided with a dip tube for sucking the content in the container body, and a cap for installing the dip tube on a mouth of container body via a sealing member.

In addition, the trigger type fluid dispenser is provided with a nozzle in the discharge flow path via a spin element. The content sucked from the container body by the user's trigger operation is discharged as a mist form from a discharge port via the discharge flow path while spinning in a portion between the spin element and the nozzle.

The conventional trigger pump is formed by many parts as described above, and hence it has a problem in that the assembling work is complicated and the cost increases. In particular, since the return spring is formed of a metal such as stainless steel, and is disposed between the piston and the cylinder, the conventional trigger pump has a disadvantage that the return spring is liable to come into contact with the content via the communicating hole, and not only the assembling is difficult to perform, but also it is necessary to sort the return spring from other resin-made parts when disposing.

DISCLOSURE OF THE INVENTION

The present invention has been made to solve the above-mentioned problems, and accordingly it has for an object to improve the workability of assembling, to reduce the cost, and to secure easiness of disposal by decreasing the number of parts constituting a trigger type fluid dispenser.

To achieve the above object, the present invention provides a trigger type fluid dispenser including a body which is provided with a discharge flow path for discharging a fluid in the horizontal direction and has a cylinder disposed in parallel with the discharge flow path; a trigger held to be swingable with respect to the body; and a piston which slides reciprocatively in the cylinder in cooperation with the trigger, wherein the trigger includes a hook portion which is held to be swingable with respect to the body, and an elastic portion in which an extension portion integrally extending from a swinging portion of the hook portion is turned down, the turned-down portion is held with respect to the body, and the tip end of the extension portion is positioned to be capable of coming into contact with the hook portion.

According to the present invention, the push-in action of piston in the cylinder is brought about in cooperation with the pulling operation of trigger. On the other hand, when the finger is removed from the trigger, the pushback action of piston in the cylinder is brought about by the urging force produced in an elastic portion formed integrally with the hook portion. Therefore, it is unnecessary to provide a separate return spring that is liable to come into contact with the content and moreover difficult to assemble. For this reason, the workability of assembling can be improved and the manufacturing cost can also be reduced by the elimination of return spring effected by the commonness of the hook portion and the elastic portion.

Moreover, since the trigger is provided with the elastic portion integral with the hook portion, all parts of the trigger type fluid dispenser can be made of resin, so that the manufacture and disposal becomes easy. In particular, when all components are formed of the same resin (for example, polypropylene), sorting of different resins having a different composition is unnecessary, so that this configuration is best suitable.

In addition, the elastic portion is configured so that the extension portion integrally extending from the swinging portion of the hook portion is turned down and the turned-down portion is held by the internal wall of the body, and also the tip end of the extension portion is positioned to be capable of coming into contact with the hook portion. Therefore, the elastic portion is easily restored and the pushback action after the finger is removed from the trigger is executed rapidly, so that the operability is also improved.

The trigger type fluid dispenser in accordance with the present invention can be configured to further include a cover which is installed to the body to form an internal space between the cover and the discharge flow path, and so that the turned-down portion of the trigger is held by the body or cover.

The trigger type fluid dispenser in accordance with the present invention can be configured so as to further include a discharge valve which is opened by the push-in action of the piston to discharge a fluid in the discharge flow path to the outside, and a suction valve which is opened by the push-back action of the piston to suck a fluid into the discharge flow path.

In the present invention, the configuration can be such that the discharge valve and the suction valve are tongue-shaped elements integrally provided on a core element which is inserted in the discharge flow path and the internal space to form a flow path between the discharge flow path and the internal space, and the discharge valve is located near a discharge port of the discharge flow path and the suction valve is located in the internal space.

As another embodiment, the configuration can be such that the discharge valve and the suction valve are tongue-shaped elements integrally provided on a core element which is inserted in the discharge flow path and the internal space to form a flow path between the discharge flow path and the internal space, and the discharge valve and the suction valve are located in the internal space.

Further, as still another embodiment, the configuration can be such that the suction valve includes a first core element which is inserted in the internal space or in the internal space and discharge flow path and has an internal flow path, and a second core element which is inserted in the discharge flow path and has a valve element which closes the internal flow path and a first hollow tube for holding the valve element to be capable of opening and closing the valve element via a spring, and the discharge valve includes a third core element which is inserted in the first hollow tube and the discharge flow path and has a valve element which closes the first hollow tube and a second hollow tube for holding the valve element to be capable of opening and closing the valve element via a spring.

The configuration can be such that the body integrally includes a spin element near the discharge port of the discharge flow path.

The configuration can be such that the body integrally includes a connecting portion for connecting the body to a mouth of a container body.

The configuration can be such that the trigger is arranged so that the elastic portion is located on almost the same level as the discharge flow path.

The configuration can be such that the elastic portion is constructed so that on one side of the turned-down portion of the extension portion, a bent portion in which the extension portion is bent at least one place is provided, and on the other side thereof, a wavy portion in which the extension portion is bent at a plurality of places is provided.

It is preferable that either one of the trigger and the piston have a holding pin and the other have an opening having a diameter larger than that of the holding pin, and by inserting the holding pin in the opening, the trigger and the piston be operated in cooperation with each other.

BRIEF DESCRIPTION OF THE DRAWINGS

Preferred embodiments of the present invention will be described below in further, with reference to the accompanying drawings

BEST MODE FOR CARRYING OUT THE INVENTION

Figure 1A:
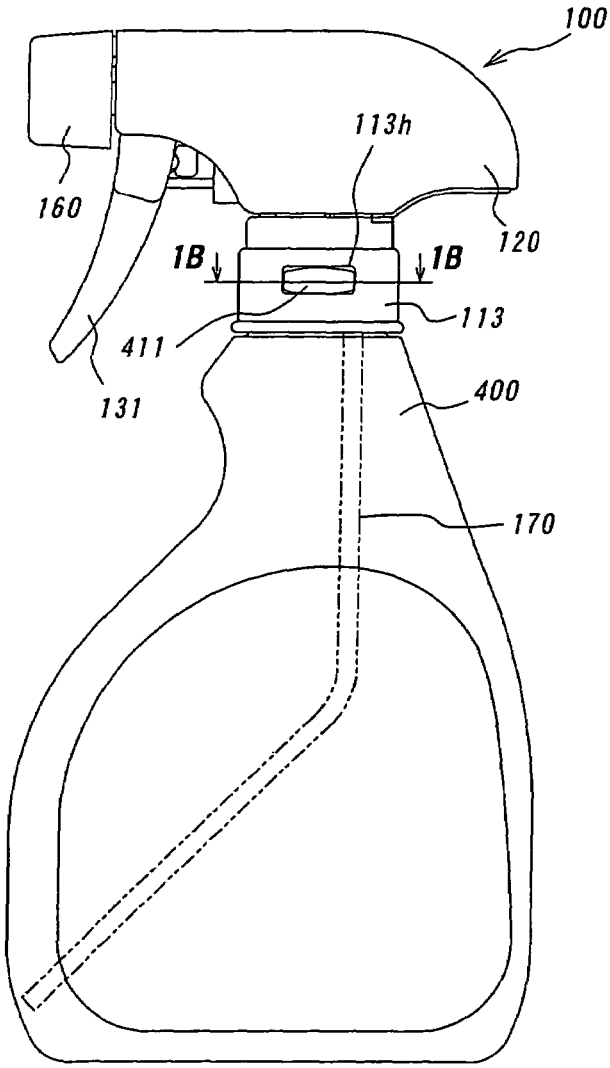
FIG. 1A is a front view of a vessel fitted with a trigger pump in accordance with a first embodiment of the present invention.
Figure 1B:
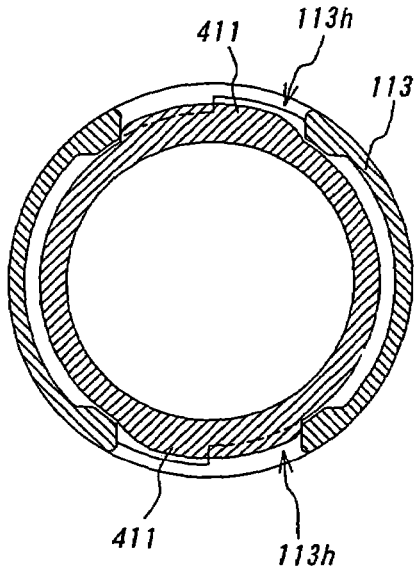
FIG. 1B is a sectional view taken along the line 1B-1B of FIG. 1A.
Figure 3A:
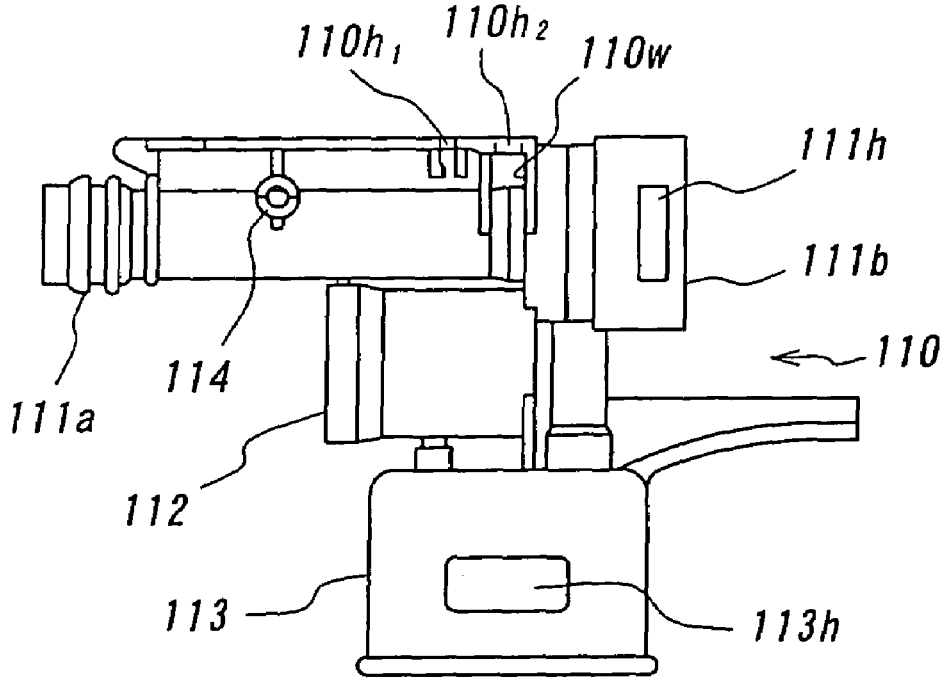
FIG. 3A is a side view of a body of the trigger pump shown in FIG. 1A.
Figure 3B:
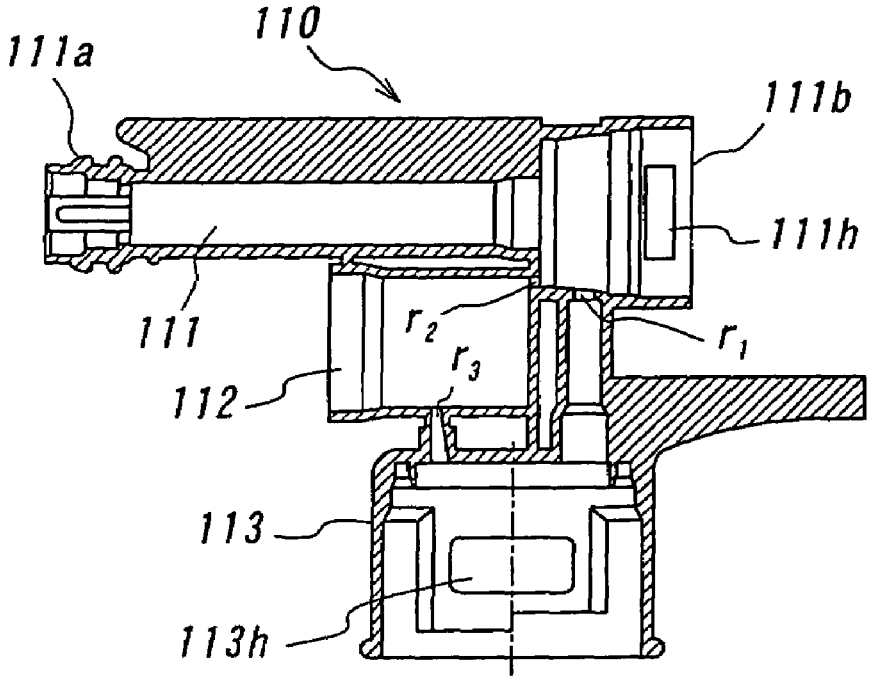
FIG. 3B is a sectional view thereof.
Figure 4A:
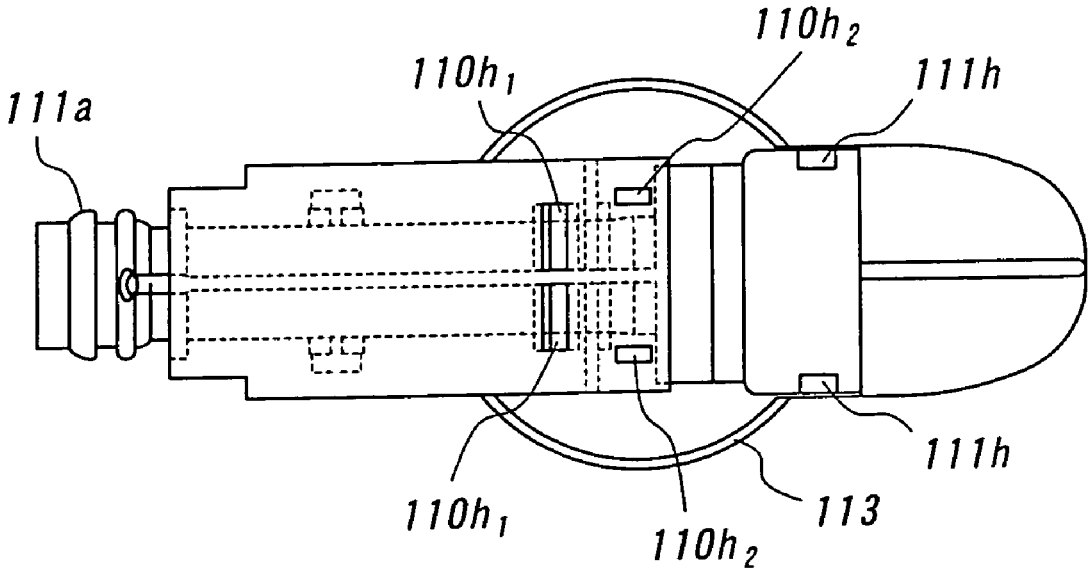
FIG. 4A is a plan view of the body shown in FIGS. 3A and 3B.
Figure 4B:
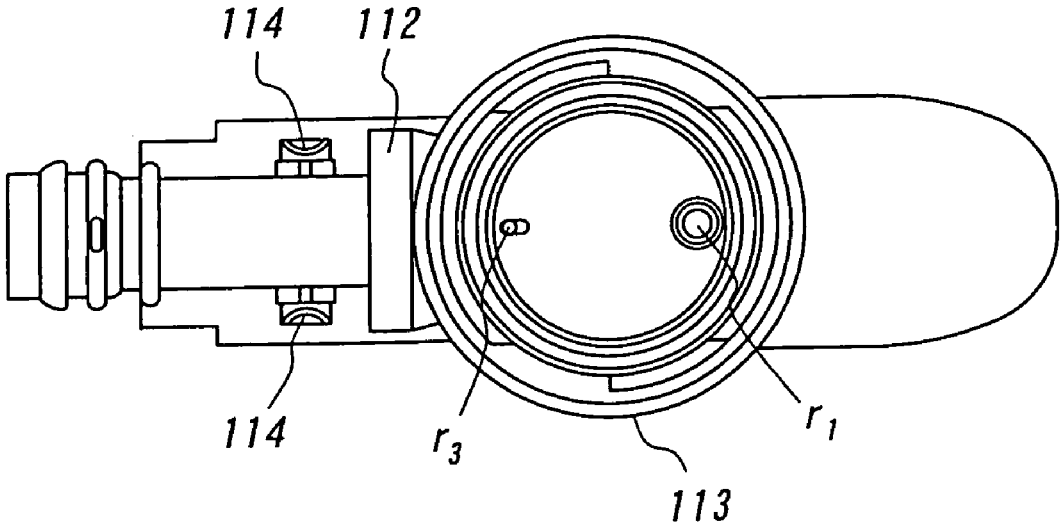
FIG. 4B is a bottom view thereof.

FIGS. 1A and 1B show a state in which a trigger pump 100 in accordance with a first embodiment of a trigger type fluid dispenser of the present invention is installed to a vessel 400. The trigger pump 100 is composed of seven parts of a body 110, a cover 120, a trigger 130, a piston 140, a core element 150 integrally provided with a discharge valve and a suction valve, a nozzle 160, and a dip tube 170. As shown in FIGS. 3A and 3B, the body 110 integrally includes a discharge flow path 111 for discharging a fluid in the horizontal direction, a cylinder 112 disposed in parallel under the discharge flow path 111, and a connecting portion 113, described later. The discharge flow path 111 integrally has a spin element near a discharge port 111*a* thereof, and a rear end opening 111*b* thereof, which is a large-diameter portion forming a step portion, communicates with the dip tube 170 introduced through an opening in the connecting portion 113 via a first passage R1. The cylinder 112 communicates with the discharge flow path 111 via a second passage R2, and communicates with the connecting portion 113 via a third passage R3.

The connecting portion 113, which is a portion for connecting the trigger pump 100 to a mouth 410 (see FIG. 2) of the container body 400, has openings 113*h* in which convex portions 411 provided on the mouth 410 of the container body 400 are fitted as shown in FIG. 1B. In this case, the body 110 can be installed to and positioned with respect to the container body 400 merely by fitting the convex portions 411 of the container body 400 in the openings 113*h* formed in the connecting portion 113. Moreover, if the convex portions 411 of the container body 400 exposed from the openings 113*h* are pushed toward the inside of the container body 400, the body 110 can easily be removed from the container body 400.

The connecting portion 113 may be configured so as to be formed with concave portions that are not open to the outside of the body 110 in place of the openings 113*h* if the concave portions have a shape that fits to the convex portions 411 provided on the container body 400, and the convex portions 411 provided on the container body 400 may be fitted in these concave portions. Inversely, the connecting portion 113 may be formed with convex portions that fit in openings or concave portions formed in the mouth 410 of the container body 400. Further, threads provided on the internal surface of the connecting portion 113 may be engaged with threads provided on the external surface of the mouth 410 of the container body 400.

Figure 2:
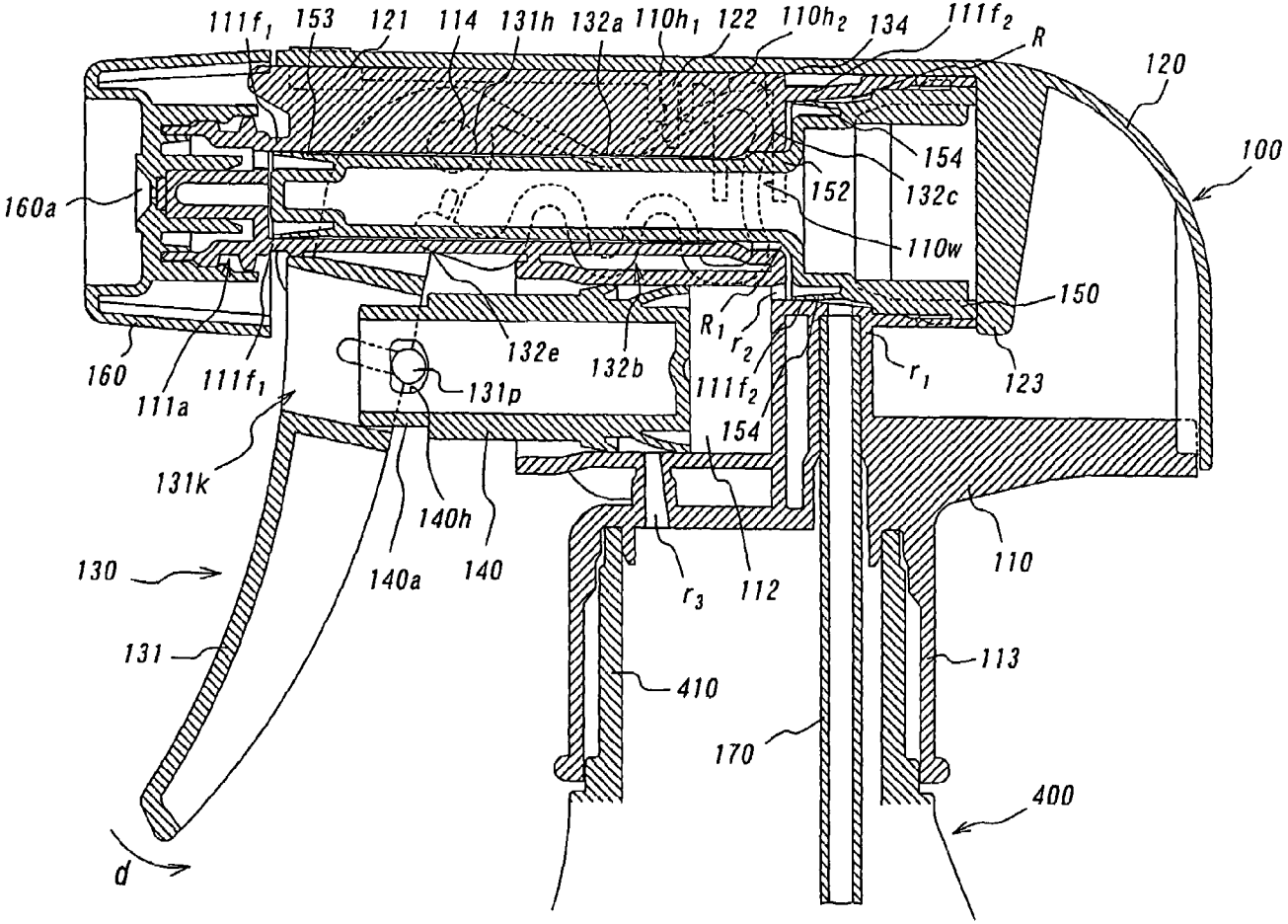
FIG. 2 is a sectional view of the trigger pump shown in FIG. 1, which is viewed from the side.
Figure 5B:
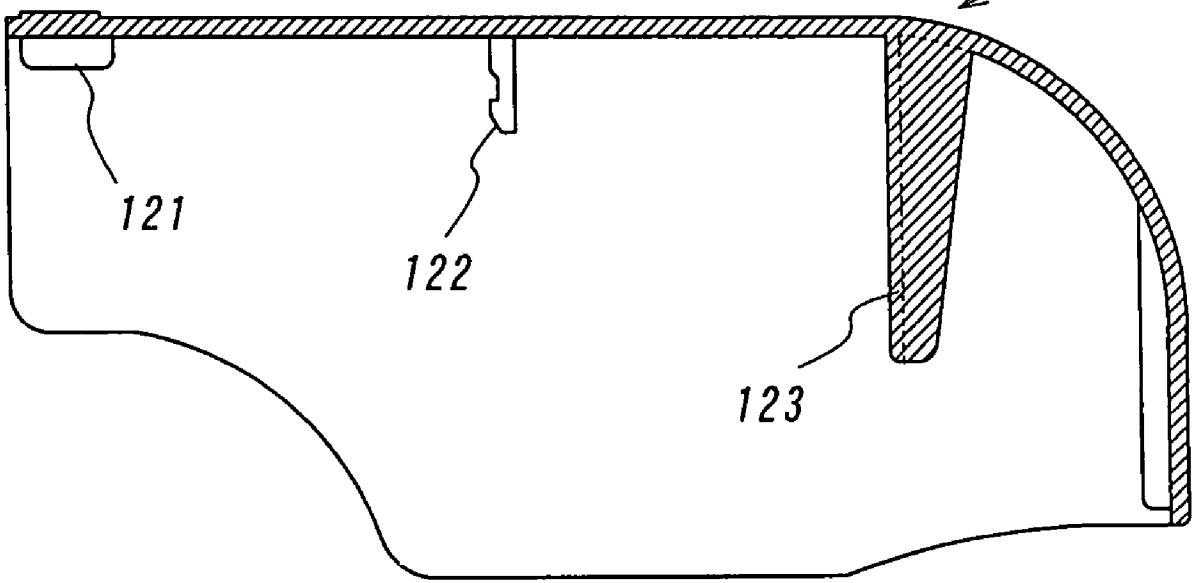
FIG. 5B is a sectional view taken along the line 5B-5B of FIG. 5A.
Figure 5A:
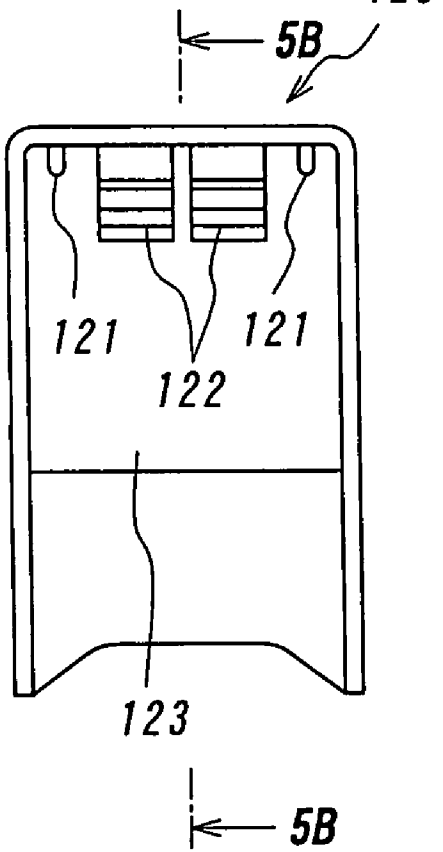
FIG. 5A is a front view of a cover of the trigger pump shown in FIG. 1A.

As shown in FIGS. 5A and 5B, the cover 120 integrally has two guide plates 121, two hook portions 122, and a partition plate 123 on the inside of the top plate thereof. The guide plates 121 fulfill the function of positioning the cover 120 with respect to the body 110 as shown in FIG. 2. The hook portions 122 fit in two hook holes 110$h_1$ formed on the top surface of the body 110, and thereby fulfill the function of fixing the cover 120 to the body 110. When the cover 120 is installed to the body 110, the partition plate 123 closes the rear end opening 111*b* of the discharge flow path 111, by which an internal space R is formed between the discharge flow path 111 and the cover 120 as shown in FIG. 2.

Figures 6A, 6B, 6C:
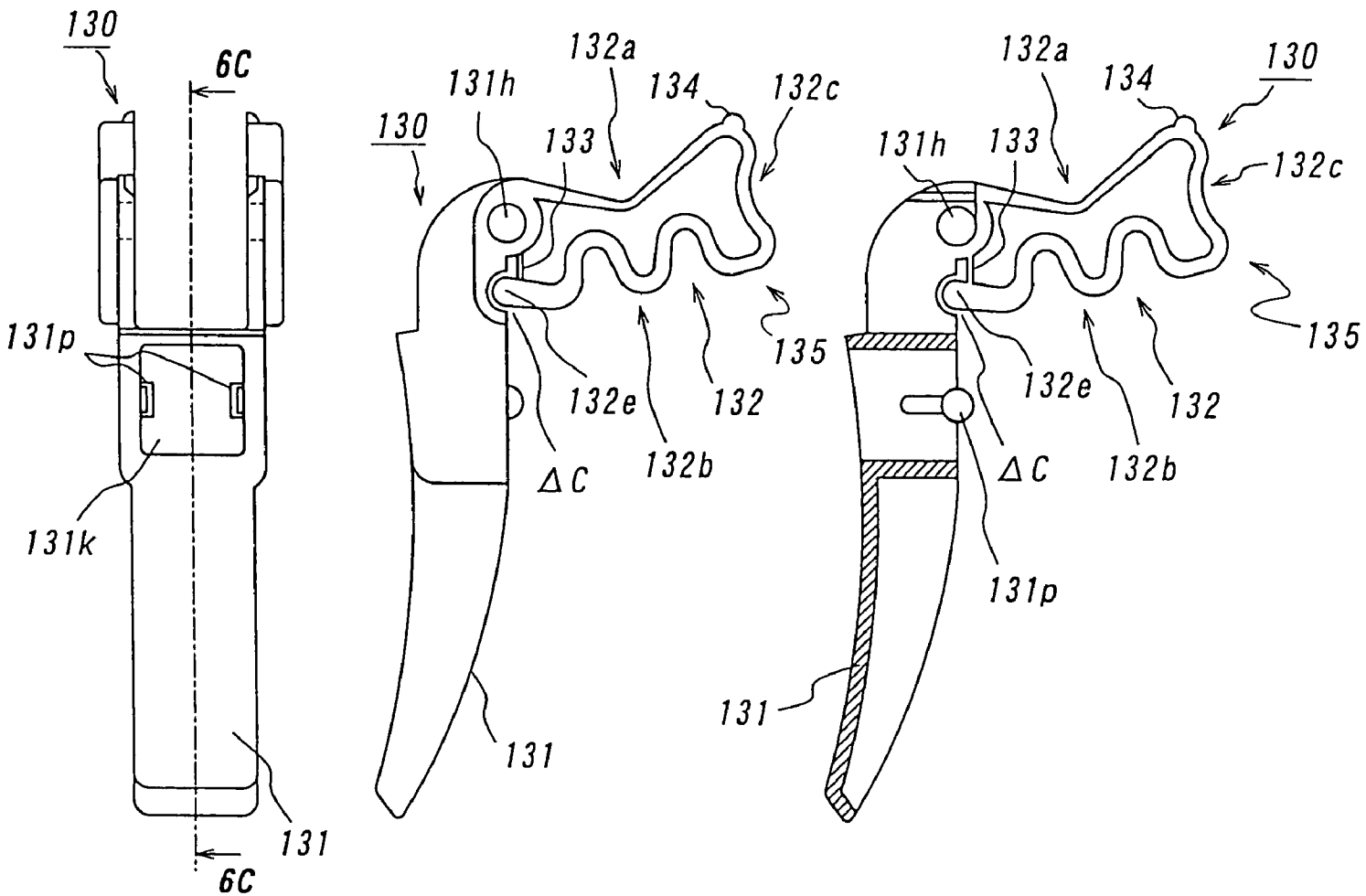
FIG. 6A is a front view of a trigger of the trigger pump shown in FIG. 1A.
FIG. 6B is a side view thereof.
FIG. 6C is a sectional view taken along the line 6C-6C of FIG. 6A.
Figure 7A:
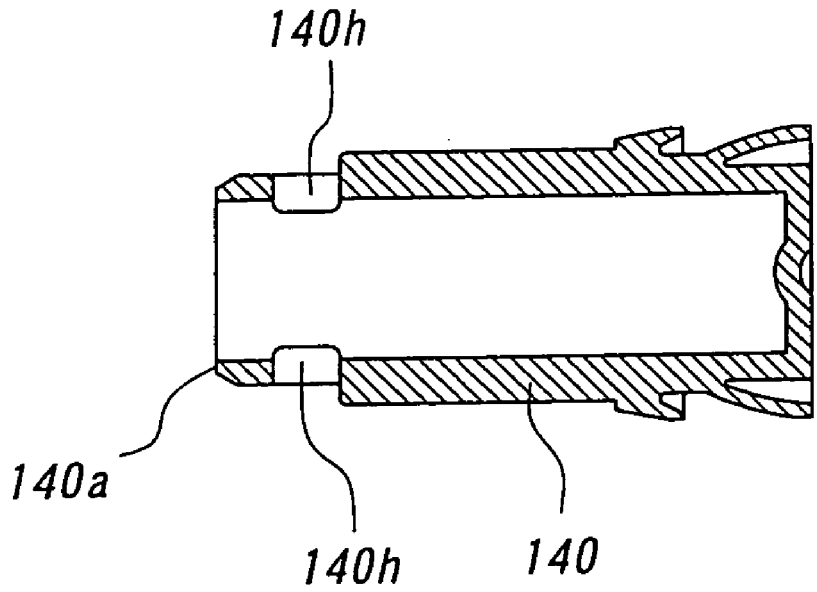
FIG. 7A is a sectional view showing the upper surface of a piston of the trigger pump shown in FIG. 1A.
Figure 7B:
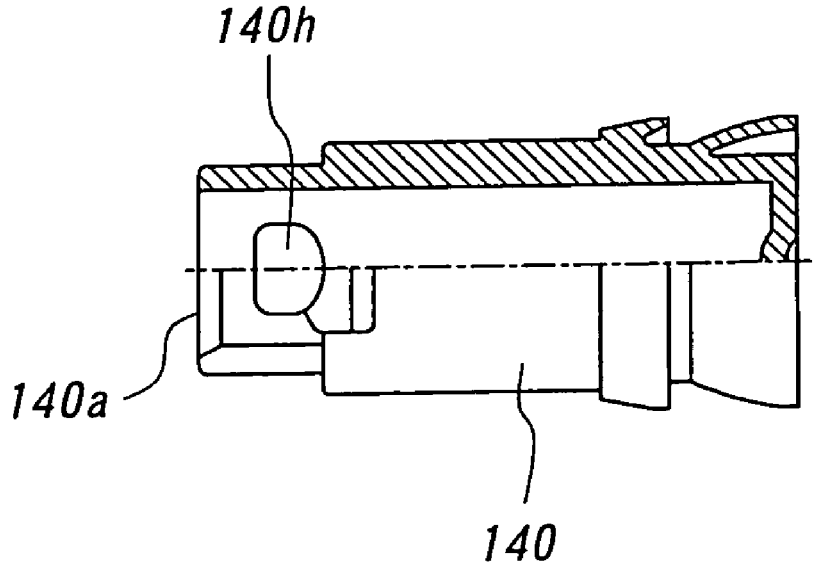
FIG. 7B is a partially sectioned side view of the piston.
Figure 8A:
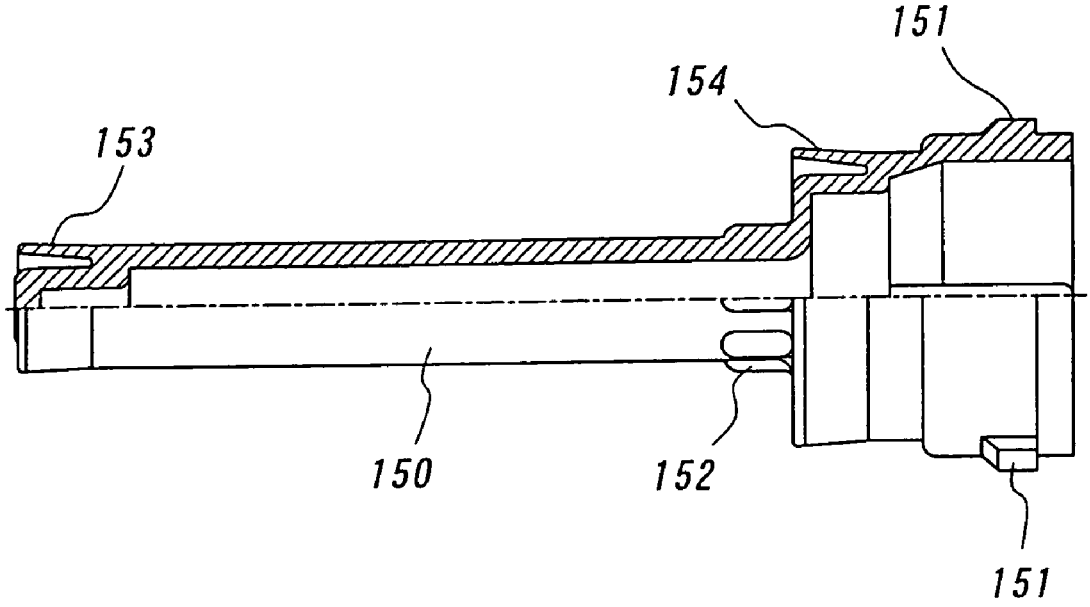
FIGS. 8A and 8B are partially sectional views showing the upper surface and the side surface of a core element of the trigger pump shown in FIG. 1A, respectively.
Figure 8B:
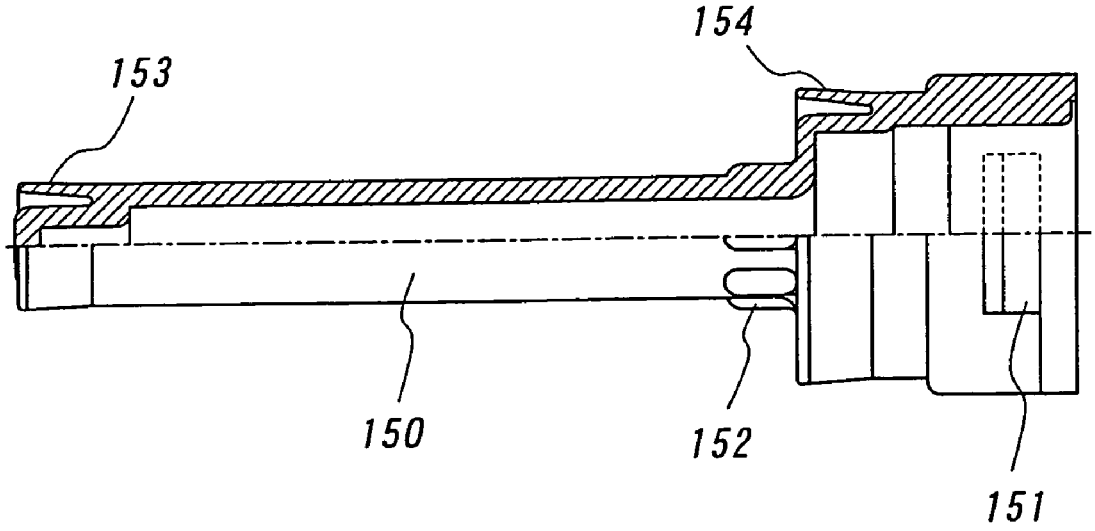

As shown in FIGS. 6A to 6C, the trigger 130 has a pin hole 131*h*, in which a pin 114 provided on the body 110 is fitted, formed in a hook portion 131 on which the user puts his/her finger, and is thereby held by the body 110 so as to be swingable. The trigger 130 is provided with an elastic portion 132 integrally with the hook portion 131. The elastic portion 132 has a shape such that two extension portions extending from the pin hole 131*h*, which is a swinging portion of the hook portion 131, are turned down and each of tip ends 132*e* of the extension portions is supported by a beam 133 provided near the pin hole 131*h* so as to provide a predetermined clearance Δc. On one side of a turned-down portion 132*c* of the extension portion, a bent portion 132*a* in which the extension portion is bent at one place is provided, and on the other side thereof, a wavy portion 132*b* in which the extension portion is bent at a plurality of places is provided.

When the trigger 130 is assembled to the body 110, as shown in FIG. 2, the elastic portion 132 is arranged so that it is located at almost the same level as the discharge flow path 111, and the turned-down portion 132*c* formed by turning down the extension portion is held by an internal wall 110*w* provided in the body 110. At this time, the elastic portion 132 is positioned to come into contact with the hook portion 131. In this embodiment, a protrusion 134 is provided on the turned-down portion 132*c*, and the protrusion 134 is fitted in a mounting hole 110$h_2$ formed in the top surface of the body 110, by which the trigger 130 is fixed more firmly to the body 110.

As shown in FIGS. 6A to 6C, the trigger 130 has a pin hole 131*h*, in which a pin 114 provided on the body 110 is fitted, formed in a hook portion 131 on which the user puts his/her finger, and is thereby held by the body 110 so as to be swingable. The trigger 130 is provided with an elastic portion 132 integrally with the hook portion 131. The elastic portion 132 has a shape such that two extension portions 135 extending from the pin hole 131*h*, which is a swinging portion of the hook portion 131, are turned down and each of tip ends 132*e* of the extension portions 135 is supported by a beam 133 provided near the pin hole 131*h* so as to provide a predetermined clearance Δc. On one side of a turned-down portion 132*c* of each of the extension portions 135, a bent portion 132*a* in which each of the extension portions 135 is bent at one place is provided, and on the other side thereof, a wavy portion 132*b* in which each of the extension portions 135 is bent at a plurality of places is provided.

When the trigger 130 is assembled to the body 110, as shown in FIG. 2, the elastic portion 132 is arranged so that it is located at almost the same level as the discharge flow path 111, and the turned-down portion 132*c* formed by turning down each of the extension portions 135 is held by an internal wall 110*w* provided in the body 110. At this time, the elastic portion 132 is positioned to come into contact with the hook portion 131. In this embodiment, a protrusion 134 is provided on the turned-down portion 132*c*, and the protrusion 134 is fitted in a mounting hole 110$h_2$ formed in the top surface of the body 110, by which the trigger 130 is fixed more firmly to the body 110.

Figure 9A:
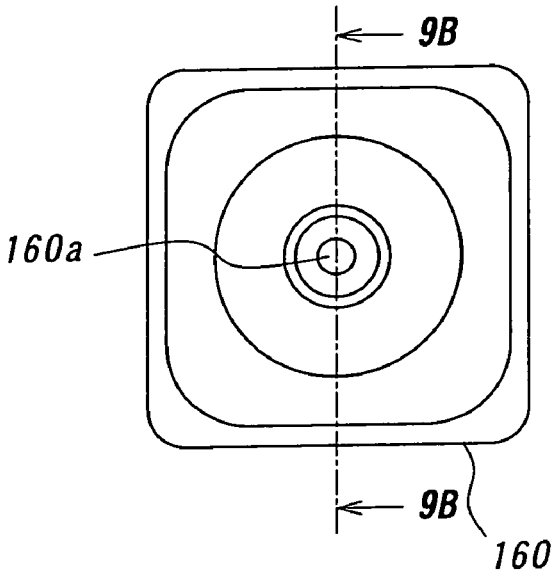
FIG. 9A is a front view of a nozzle installed near a discharge port of a body.
Figure 9B:
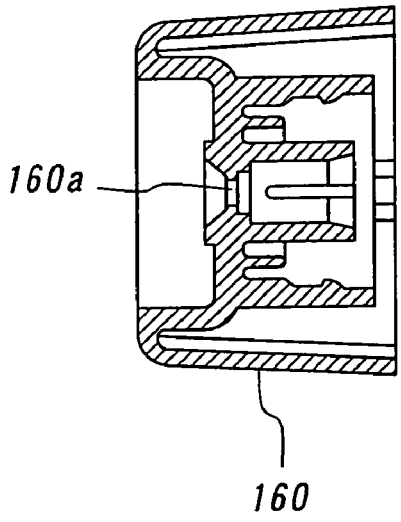
FIG. 9B is a sectional view taken along the line 9B-9B of FIG. 9A.

As shown in FIGS. 9A and 9B, the nozzle 160 is installed near the discharge port 111*a* of the discharge flow path 111 in the body 110. The body 110 is integrally provided with the spin element near the discharge port 111*a* of the discharge flow path 111, and the nozzle 160 is installed at the outer periphery thereof.

Here, the operation of the vessel 400 fitted with the trigger pump 100 in accordance with the first embodiment will be described.

As shown in FIG. 2, first, the user pulls the hook portion 131 of the trigger 130 in the direction of arrow d, by which the piston 140 is pushed into the cylinder 112 against the elastic force of the elastic portion 132 of the trigger 130 in cooperation with the pulling operation of the trigger 130 to pressurize the interior of the enclosed space R1. At this time, the tip end 132*e* of the extension portion of the elastic member 132 presses the hook portion 131, and on the other hand, the bent portion 132*a* extends, and at the same time, the wavy portion 132*b* contracts.

As a result, the pressure in the enclosed space R1 increases. Therefore, the discharge valve 153 is separated from the seat portion 111$f_1$ against the elastic force thereof while the suction valve 154 is kept seated. After the air in the enclosed space R1 is discharged from the discharge flow path 111 to the nozzle 160, the discharge valve 153 is seated again on the seat portion 111$f_1$ by the elastic force thereof. Subsequently, when the user removes his/her hand from the trigger 130, the bent portion 132*a* contracts, and at the same time, the wavy portion 132*b* extends and is restored. Therefore, the piston 140 is pushed back via the trigger 130 by the urging force of the elastic portion 132, by which a negative pressure is produced in the enclosed space R1. Thereupon, the suction valve 154 is separated from the seat portion 111$f_2$ against the elastic force thereof while the discharge valve 153 is seated, and sucks the content in the container body 400 via the dip tube 170 and the first passage R1 and introduces it into the enclosed space R1.

Subsequently, the user repeats the pulling operation of the trigger 130. Thereby, the pressure of content filled in the enclosed space R1 is increased and decreased, so that the discharge valve 153 and the suction valve 154 are opened and closed alternately. As a result, the content in the container body 400 is sucked up, and the sucked content passes through the discharge flow path 111 and is spun at the discharge port 111*a* and the nozzle 160, by which the content is sprayed from an opening 160*a* of the nozzle 160.

Specifically, the push-in action of the piston 140 in the cylinder 112 is brought about in cooperation with the pulling operation of the trigger 130, and when the finger is removed from the trigger 130, the push-back action of the piston 140 in the cylinder 112 is brought about by the urging force produced by the elastic portion 132 formed integrally with the hook portion 131. Therefore, the trigger pump 100 need not be provided with a separate return spring that is liable to come into contact with the content and moreover difficult to assemble. For this reason, the workability of assembling can be improved and the manufacturing cost can also be reduced by eliminating return spring effected by the commonness of the hook portion 131 and the elastic portion 132.

Moreover, the trigger 130 is provided with the elastic portion 132 integral with the hook portion 131, by which all parts in the trigger pump 100 can be made of resin, so that the manufacture and disposal are made easy. In particular, when all components are formed of the same resin (for example, polypropylene), sorting of different resins having a different composition is unnecessary, so that this configuration is best suitable. The resin used for the trigger 130 can be used properly depending on each part. For example, PP (polypropylene) is used when the cost is considered, and POM (polyacetal) is used when durability is considered. In addition, all existing resins including PE (polyethylene) and PET (polyethylene terephthalate) can be used according to the function and objective of each part.

Furthermore, the elastic portion 132 is configured so that the extension portion integrally extending from the pin hole 131*h*, which is a swinging portion of the hook portion 131, is turned down and the turned-down portion 132*c* is held by the internal wall 110*w* of the body 110, and also the tip end 132*e* of the extension portion is positioned to be capable of coming into contact with the hook portion 131. Therefore, the elastic portion 132 is easily restored and the pushback action after the finger is removed from the trigger 130 is executed rapidly, so that the operability is also improved. For the trigger 130 of this embodiment, the tip end 132*e* of the extension portion is supported integrally by the beam 133 with respect to the hook portion 131 to prevent the tip end from shifting transversely with respect to the spray direction and from becoming in a non-contact state with respect to the pull portion 131. However, the tip end 132*e* may be positioned without being supported by the beam 133.

In addition, the elastic portion 132 may be of a shape such that the extension portion is turned down and the tip end 132*e* is positioned to be capable of coming into contact with the hook portion 131. However, when the restoring ability and durability of the elastic portion 132 are considered, it is preferable that on one side of the turned-down portion 132*c* of the extension portion, the bent portion 132*a* in which the extension portion is bent at one place be provided, and on the other side thereof, the wavy portion 132*b* in which the extension portion is bent at a plurality of places be provided. In particular, it is most effective to arrange the bent portion 132*a* and the wavy portion 132*b* as in this embodiment.

Moreover, it is preferable that the trigger 130 be arranged so that the elastic portion 132 is located at almost the same height position as that of the discharge flow path 111. In this case, the height dimension of the cover 120 is kept at the minimum while the pulling operation of the trigger 130 is transmitted most efficiently to the piston 140, whereby the size of the trigger pump 100 can be reduced.

Furthermore, for the trigger pump 100 in accordance with the first embodiment, since the core element 150 inserted in the discharge flow path 111 and the internal space R is integrally provided with the discharge valve 153 and the suction valve 154, the number of parts constituting the trigger pump 100 can be decreased. Specifically, a total of two elements, an intake that is necessary in the conventional trigger pump, and either of elastic valve and ball valve, can be eliminated. Therefore, the decreased number of parts achieved by the commonness of the discharge valve 153 and the suction valve 154 can improve the workability of assembling and reduce the cost. In this case, since the discharge valve 153 and the suction valve 154 are annular tongue-shaped elements made of an elastic material, they can be easily manufactured and at a low cost together with the core element 150.

In addition, according to the first embodiment, since the spin element is integrally provided near the discharge port 111*a* of the discharge flow path 111, the workability of assembling can be improved, and the cost can be reduced. Further, since the body 110 is integrally provided with the connecting portion 113 for connecting the body 110 to the mouth 410 of the container body 400, the workability of assembling can be improved, and the cost can be reduced. In particular, the connecting portion 113 of this embodiment performs positioning with respect to the vessel 400, for example, fitting of the convex portions 411 of the vessel 400 in the openings 113*h* formed in the body 110, or fitting of the convex portions 411 of the vessel 400 in the concave portions formed in the body 110, so that the installation of the trigger pump 100 to the vessel 400 and the positioning thereof with respect to the vessel 400 can be accomplished easily, and hence the workability of assembling can further be improved.

As is apparent from the above description, in the trigger type dispenser provided with the discharge flow path in the horizontal direction and the cylinder under the discharge flow path, whereas the conventional trigger pump consists of 12 parts of a body, trigger, piston, return spring, discharge valve, suction valve, intake, dip tube, sealing member, cap, spin element, and nozzle, the trigger pump 100 of the first embodiment consists merely of seven parts of the body 110, cover 120, trigger 130, piston 140, core element 150 integrally provided with the discharge valve and suction valve, nozzle 160, and dip tube 170.

Figure 10:
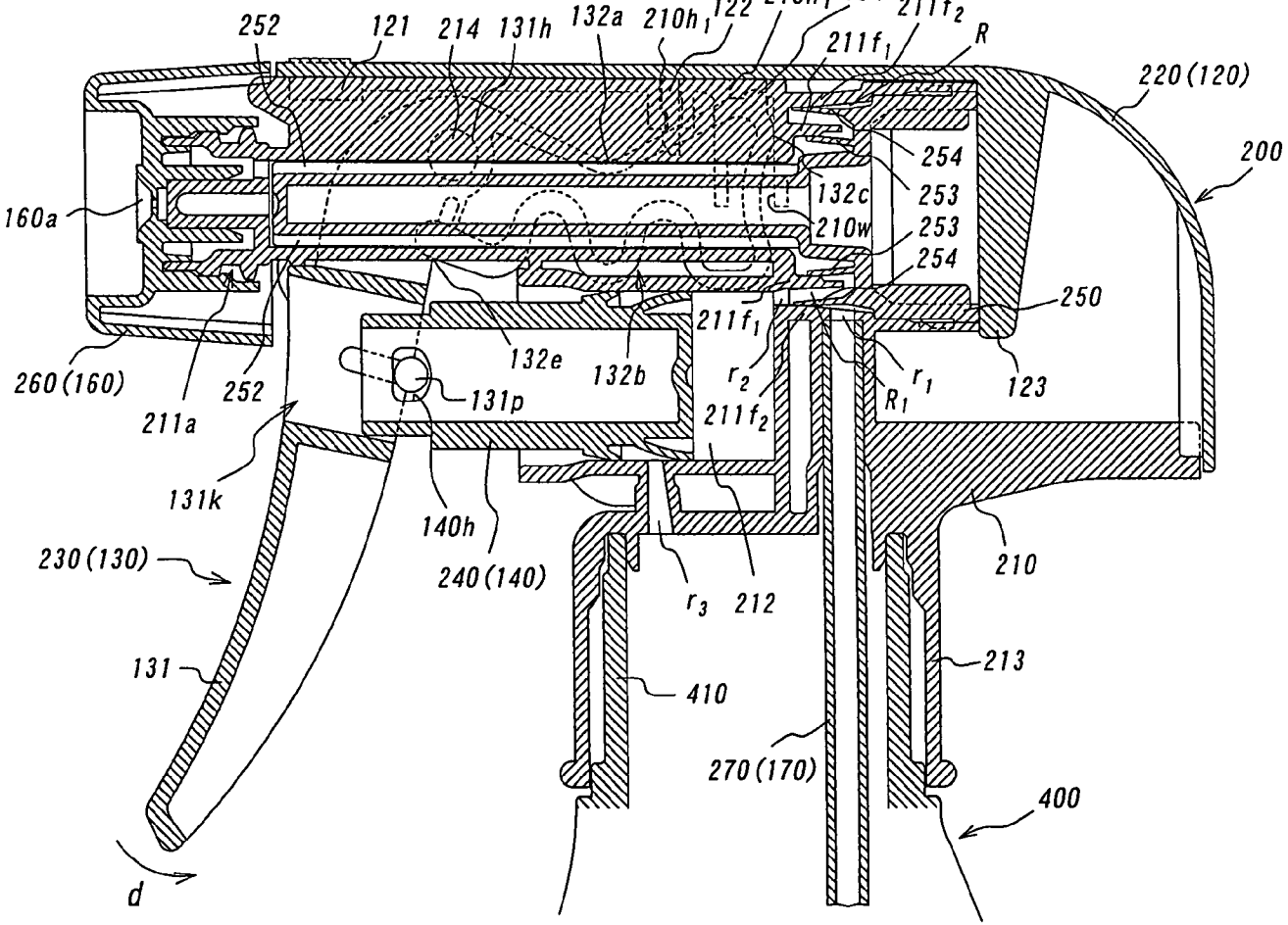
FIG. 10 is a sectional view of a vessel fitted with a trigger pump in accordance with a second embodiment of the present invention, which is viewed from the side.

FIG. 10 shows a state in which a trigger pump 200 in accordance with a second embodiment of the present invention is installed to the vessel 400. As in the first embodiment, the trigger pump 200 is composed of seven parts of a body 210, a cover 220, a trigger 230, a piston 240, a core element 250 integrally provided with a discharge valve and a suction valve, a nozzle 260, and a dip tube 270, and the arrangement of annular tongue-shaped elements 253 and 254 integrally provided on the core element 250 is different from that in the first embodiment. In this embodiment, therefore, as parts except the body 210 and the core element 250, the parts common to those of the first embodiment are used, and the explanation of the common parts is omitted.

Figure 11A:
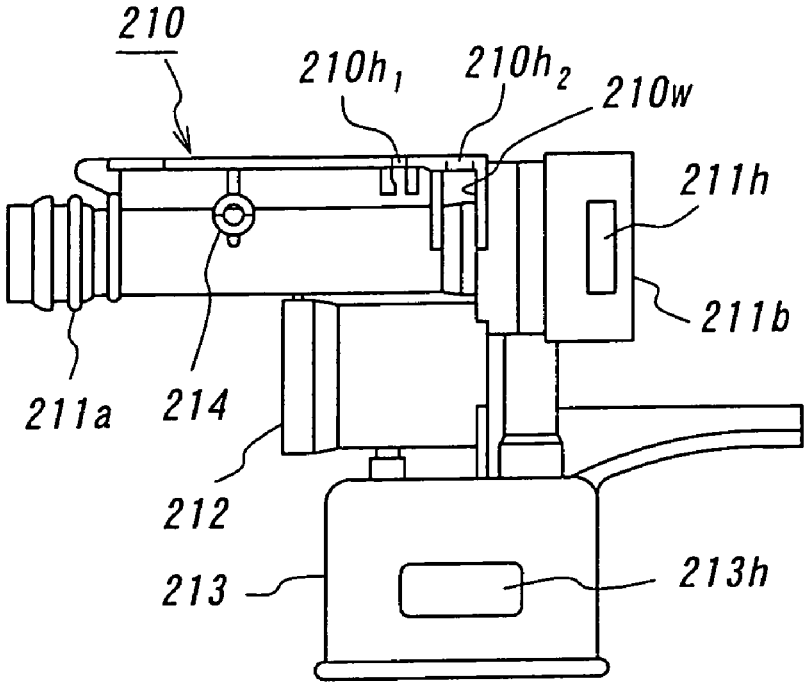
FIG. 11A is a side view of a body of the trigger pump shown in FIG. 10.
Figure 11B:
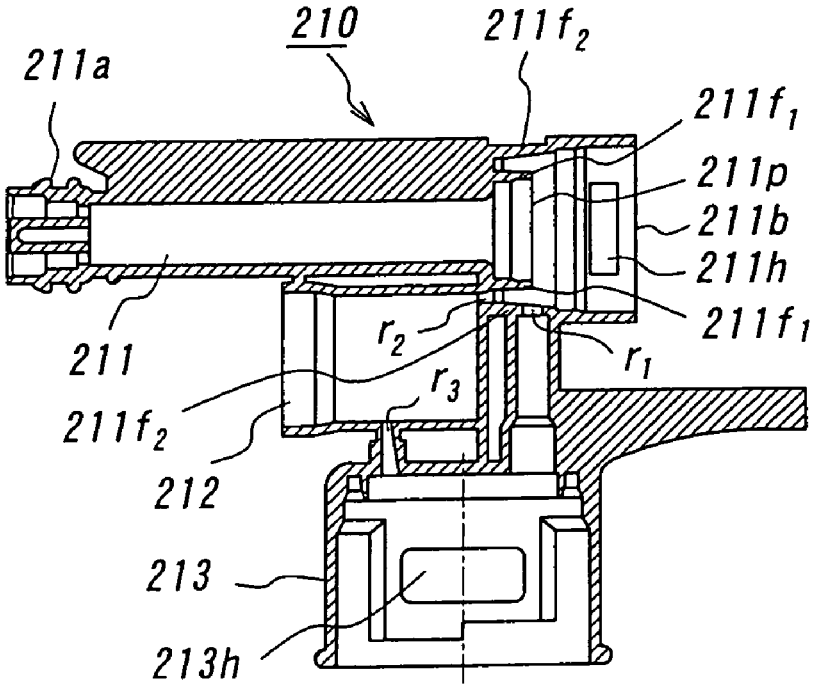
FIG. 11B is a sectional view thereof.

As shown in FIGS. 11A and 11B, the body 210 integrally includes a discharge flow path 211 for discharging a fluid in the horizontal direction, a cylinder 212 disposed in parallel under the discharge flow path 211, and a connecting portion 213. As shown in FIG. 11B, the discharge flow path 211 integrally has a spin element near a discharge port 211*a* thereof, and a rear end opening 211*b* thereof is a large-diameter portion forming a step portion. The step portion has an annular internal wall 211*p* extending in the horizontal direction, and the rear end opening 211*b* communicates with the dip tube 170 introduced through an opening in the connecting portion 213 via the first passage R1. The cylinder 212 communicates with the discharge flow path 211 via the second passage R2, and communicates with the connecting portion 213 via the third passage R3. The connecting portion 213 has openings 213*h* in which the convex portions 411 provided on the mouth 410 of the container body 400 are fitted.

As shown in FIG. 10, the trigger 130 is held by the body 210 so as to be swingable by fitting a pin 214 provided on the body 210 in the pin hole 131*h*, and the turned-down portion 132*c* of the elastic portion 132 is held by an internal wall 210*w* provided in the body 210. At this time, the elastic portion 132 is positioned so as to come into contact with the hook portion 131. In addition, the protrusion 134 provided on the turned-down portion 132*c* is fitted in each of two mounting holes 210$h_2$ formed in the top surface of the body 210, by which the trigger 130 is fixed more firmly to the body 210.

As shown in FIG. 10, the cover 120 is positioned with respect to the body 210 by the two guide plates 121 provided on the inside of the top plate thereof, and is fixed to the body 210 by fitting the two hook portions 122 provided similarly on the inside of the top plate in two hook holes 210$h_1$ formed on the top surface of the body 210. Therefore, when the cover 120 is installed to the body 210, the partition plate 123 provided on the cover 120 closes the rear end opening 211*b* of the discharge flow path 211, by which the internal space R is formed between the discharge flow path 211 and the cover 120.

Figure 12A:
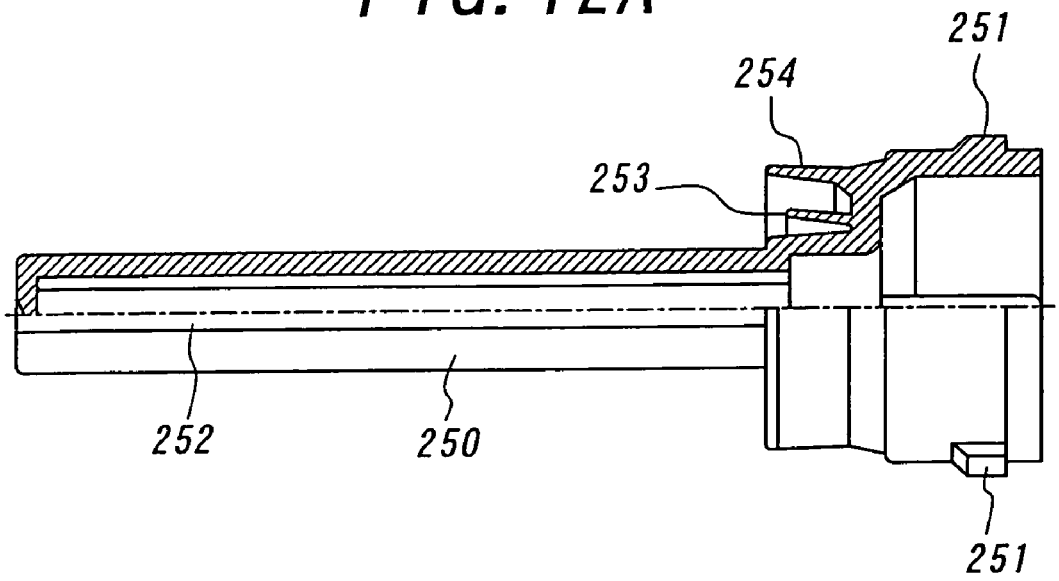
FIGS. 12A and 12B are partially sectional views showing the upper surface and the side surface of a core element of the trigger pump shown in FIG. 10, respectively.
Figure 12B:
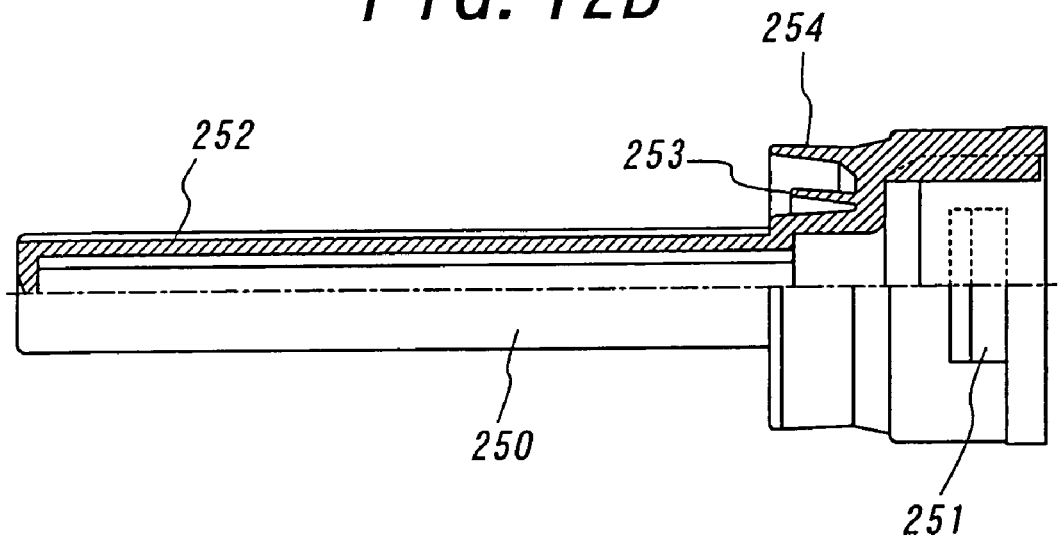

The core element 250 is formed of an elastic material such as polyethylene, and as shown in FIG. 12, it is inserted in the discharge flow path 211 and the internal space R by means of two convex portions 251 that fit in openings 211*h* formed in the body 211 and a flow path groove 252 forming a flow path between the internal wall of the discharge flow path 211 and the core element 250, by which a flow path is formed between the discharge flow path 211 and the internal space R. The core element 250 integrally has annular tongue-shaped elements 253 and 254 at a position of the internal space R. Since the tongue-shaped elements 253 and 254 are formed of an elastic material, as shown in FIG. 10, in a state in which the core element 250 is inserted in the discharge flow path 211 and the internal space R, the tongue-shaped elements 253 and 254 close an inner peripheral surface 211$f_1$ of the annular internal wall 211*p* and an inner peripheral surface 211$f_2$ of the internal space R by means of the elastic force thereof, by which the annular enclosed space R1 is defined. Therefore, as in the first embodiment, when the piston 140 is pushed into the cylinder 212 to pressurize the enclosed space R1 via the second passage R2, the tongue-shaped element 253 separates from the seat portion 211$f_1$ against the elastic force thereof, so that the enclosed space R1 is opened to the outside from the flow path groove 252 and the discharge flow path 211. On the other hand, when the piston 140 is pulled back in the cylinder 212 to decompress the enclosed space R1 via the second passage R2, the tongue-shaped element 254 separates from the seat portion 211$f_2$ against the elastic force thereof, so that the enclosed space R1 is opened. Specifically, the tongue-shaped element 253 functions as a discharge valve that is opened by the push-in action of the piston 140 brought about in cooperation with the pulling operation of the trigger 130 and discharges the fluid in the discharge flow path 211 to the outside, and the tongue-shaped element 254 functions as a suction valve that is opened by the push-back action of the piston 140 brought about in cooperation with the return of the trigger 130 caused by the urging force of the elastic portion 232 and sucks a fluid in the discharge flow path 211.

Next, the operation of the vessel 400 fitted with the trigger pump 200 in accordance with the second embodiment will be described.

As shown in FIG. 10, first, the user pulls the hook portion 131 of the trigger 130 in the direction of arrow d, by which the piston 140 is pushed into the cylinder 212 against the elastic force of the elastic portion 132 of the trigger 130 in cooperation with the pulling operation of the trigger 131 to pressurize the interior of the enclosed space R1. At this time, the tip end 232*e* of the extension portion of the elastic member 132 presses the hook portion 131, and on the other hand, the bent portion 132*a* extends, and at the same time, the wavy portion 132*b* contracts.

As a result, the pressure in the enclosed space R1 increases. Therefore, the discharge valve 253 is separated from the seat portion 211$f_1$ against the elastic force thereof while the suction valve 254 is kept seated. After the air in the enclosed space R1 is discharged from the flow path groove 252 and the discharge flow path 211 to the nozzle 160, the discharge valve 253 is seated again on the seat portion 211$f_1$ by the elastic force thereof. Subsequently, when the user removes his/her hand from the trigger 130, the bent portion 132*a* contracts, and at the same time, the wavy portion 132*b* extends and is restored. Therefore, the piston 140 is pushed back via the trigger 130 by the urging force of the elastic portion 132, by which a negative pressure is produced in the enclosed space R1. Thereupon, the suction valve 254 is separated from the seat portion 211$f_2$ against the elastic force thereof while the discharge valve 253 is seated, and sucks the content in the container body 410 via the dip tube 170 and the first passage R1 and introduces it into the enclosed space R1.

Subsequently, the user repeats the pulling operation of the trigger 130. Thereby, the pressure of content filled in the enclosed space R1 is increased and decreased, so that the discharge valve 253 and the suction valve 254 are opened and closed alternately. As a result, the content in the container body 400 is sucked up, and the sucked content passes through the discharge flow path 211 and is spun at the discharge port 211*a* and the nozzle 160, by which the content is sprayed from the opening 160*a* of the nozzle 160.

The trigger pump 200 in accordance with the second embodiment also consists of seven parts of the body 210, cover 220, trigger 230, piston 240, core element 250 integrally provided with the discharge valve and suction valve, nozzle 260, and dip tube 270, and achieves the same operation and effects as those of the first embodiment.

Figure 13:
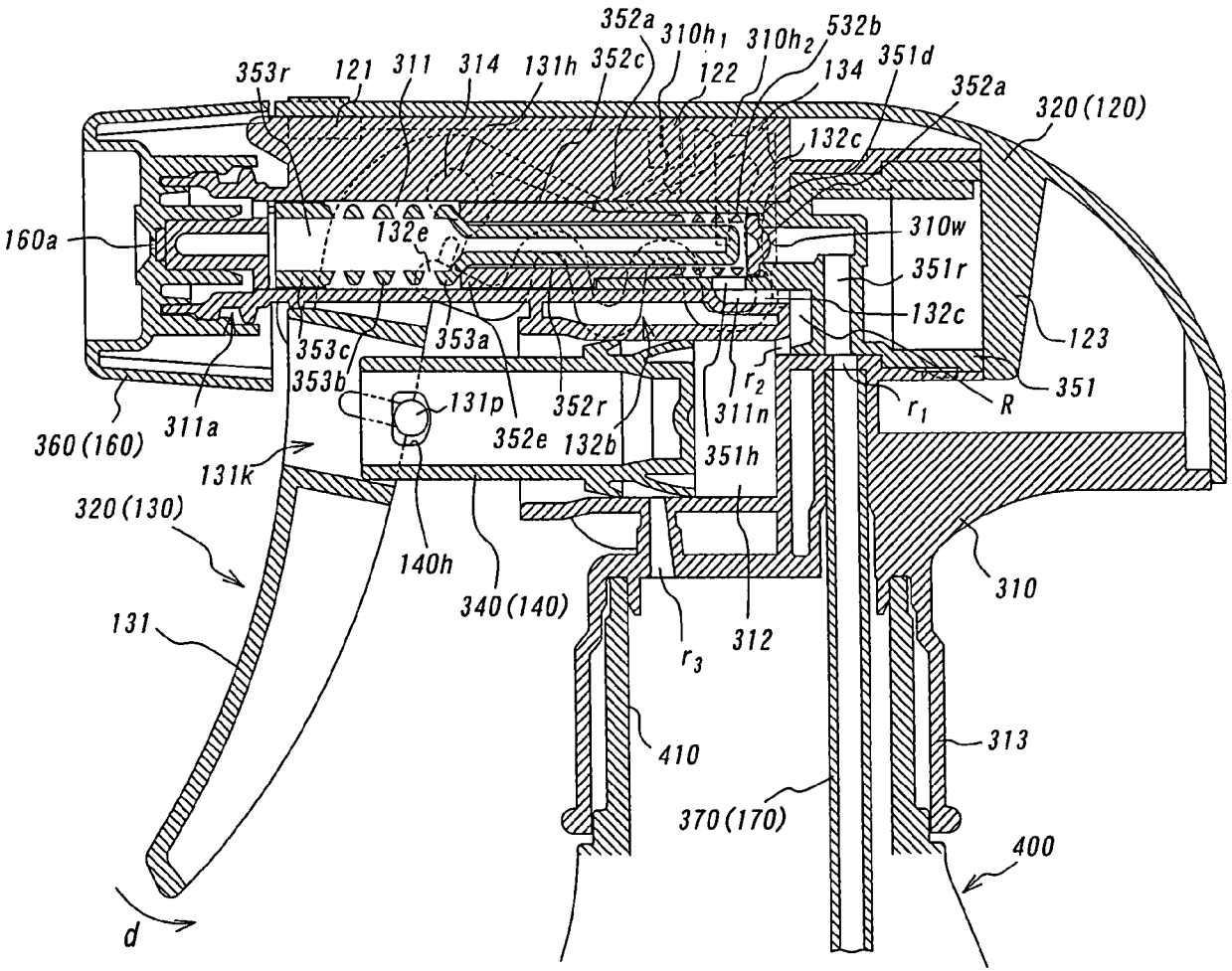
FIG. 13 is a sectional view of a vessel fitted with a trigger pump in accordance with a third embodiment of the present invention, which is viewed from the side.
Figure 14:
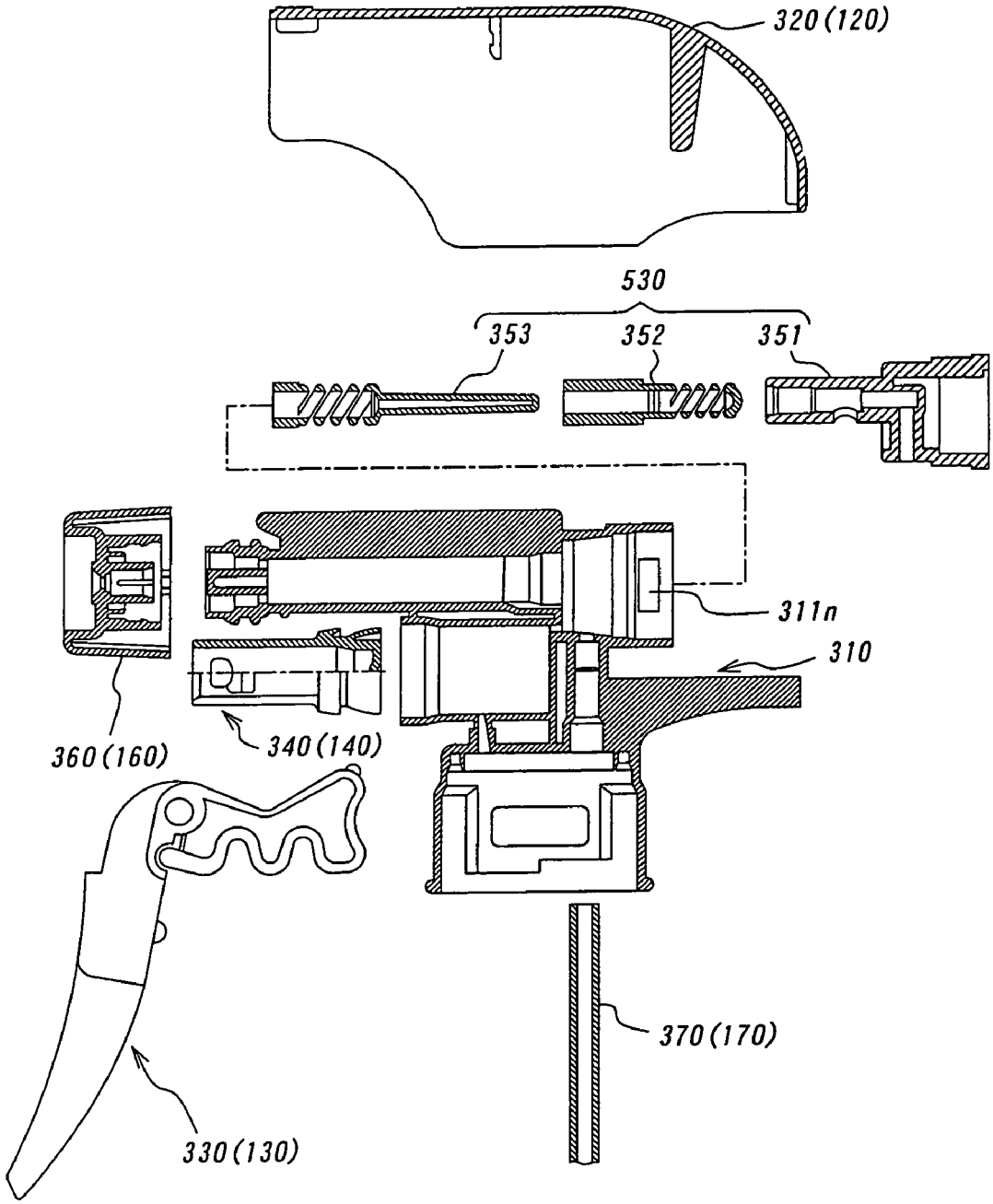
FIG. 14 is an exploded view showing all parts of the trigger pump shown in FIG. 13.

FIG. 13 shows a state in which a trigger pump 300 in accordance with a third embodiment of the present invention is installed to the vessel 400, and FIG. 14 is an exploded view of the trigger pump 300.

The trigger pump 300 includes a body 310, a cover 320, a trigger 330, a piston 340, a core element 350 forming a discharge valve and a suction valve, a nozzle 360, and a dip tube 370, and the core element 350 consists of three parts 351, 352 and 353. Therefore, in the third embodiment as well, as in the second embodiment, as parts except the body 310 and the core element 350, the parts common to those of the first embodiment are used, and the explanation of the common parts is omitted.

Figure 15A:
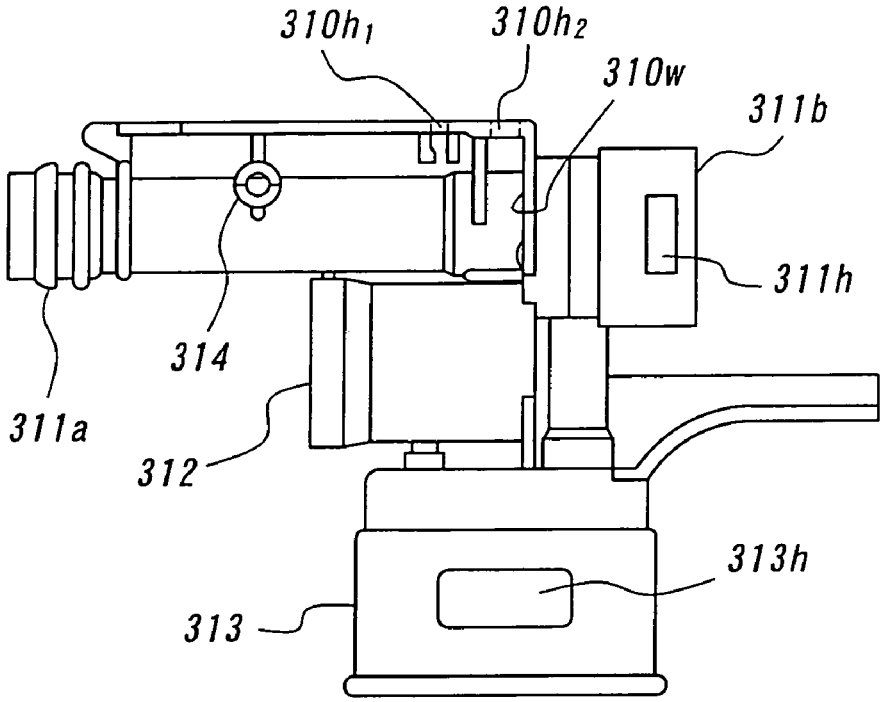
FIG. 15A is a side view of a body of the trigger pump shown in FIG. 13.
Figure 15B:
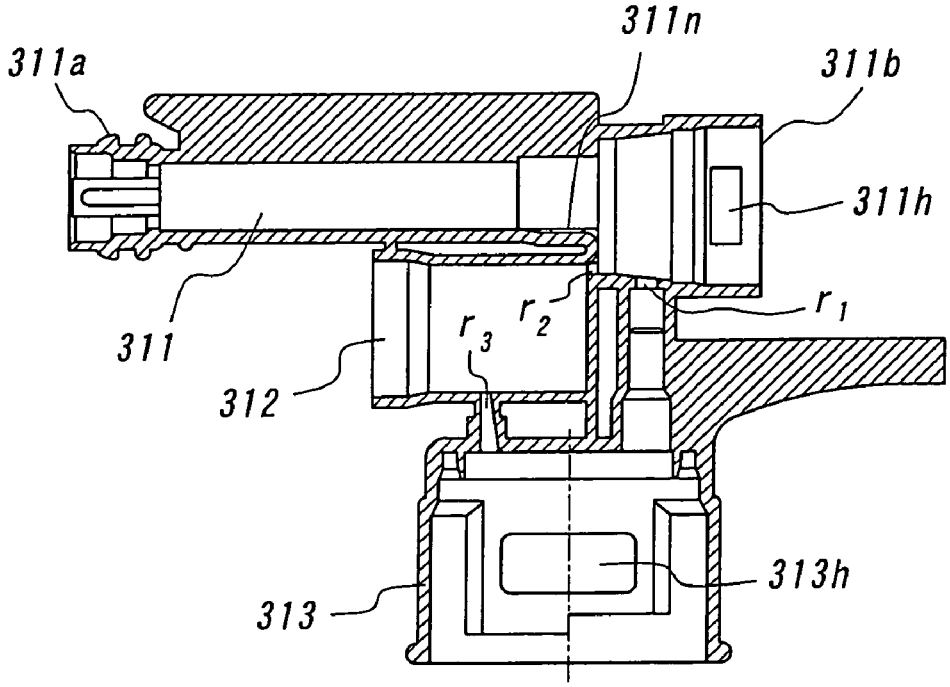
FIG. 15B is a sectional view taken along the line 15B-15B.

As shown in FIGS. 15A and 15B, the body 310 integrally includes a discharge flow path 311 for discharging a fluid in the horizontal direction, a cylinder 312 disposed in parallel under the discharge flow path 311, and a connecting portion 313. The discharge flow path 311 integrally has a spin element near a discharge port 311*a* thereof. On the other hand, a rear end opening 311*b* thereof is a large-diameter portion forming a step portion, and the step portion has a flow groove 311*n* partially extending in the horizontal direction, and the rear end opening 311*b* communicates with the dip tube 170 introduced through an opening in the connecting portion 313 via the first passage R1. The cylinder 312 communicates with the discharge flow path 311 via the second passage R2, and communicates with the connecting portion 313 via the third passage R3. The connecting portion 313 has openings 313*h* in which the convex portions 411 provided on the mouth 410 of the container body 400 are fitted.

As shown in FIG. 13, the trigger 130 is held by the body 310 so as to be swingable by fitting a pin 314 provided on the body 310 in the pin hole 131*h*, and the turned-down portion 132*c* of the elastic portion 132 is held by an internal wall 310*w* provided in the body 310. At this time, the elastic portion 132 is positioned so as to come into contact with the hook portion 131. Also, the two protrusions 134 provided on the turned-down portion 132*c* are fitted in each of two mounting holes 310$h_2$ formed in the top surface of the body 310, by which the trigger 130 is fixed more firmly to the body 310.

As shown in FIG. 13, the cover 120 is positioned with respect to the body 310 by the two guide plates 121 provided on the inside of the top plate thereof, and is fixed to the body 310 by fitting the two hook portions 122 provided similarly on the inside of the top plate in two hook holes 310$h_1$ formed on the top surface of the body 310. Therefore, as in the first embodiment, when the cover 120 is installed to the body 310, the partition plate 123 provided on the cover 120 closes the rear end opening 311*b* of the discharge flow path 311, by which the internal space R is formed between the discharge flow path 311 and the cover 120.

Figure 16A:
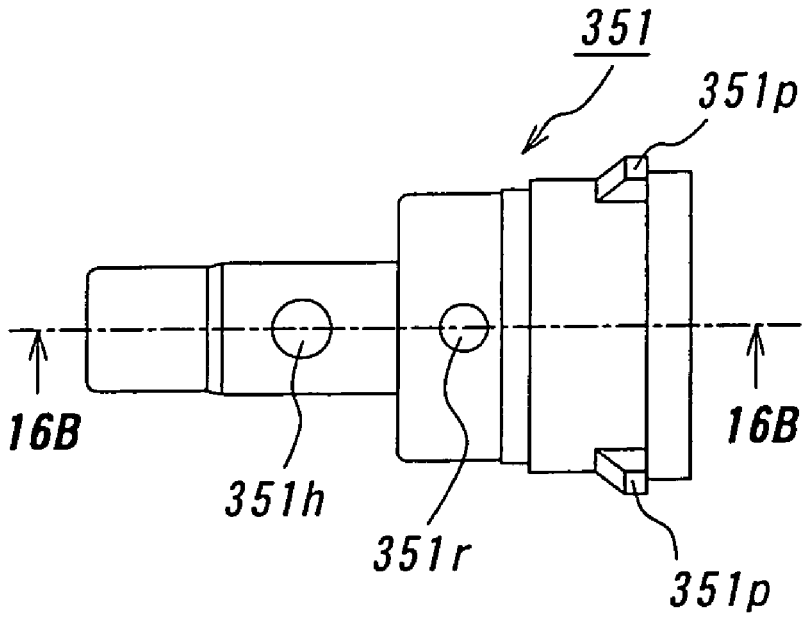
FIG. 16A is a bottom view of a first core element of the trigger pump shown in FIG. 13.
Figure 16B:
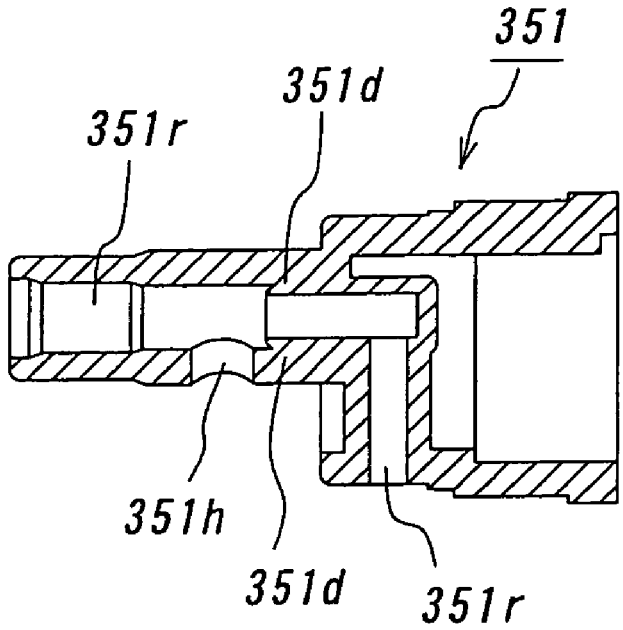
FIG. 16B is a sectional view taken along the line 16B-16B of FIG. 16A.

As shown in FIG. 16A, the first core element 351 has convex portions 351*p*, which fit in openings 311*h* formed in the body 310, on the external surface thereof, and is inserted in the discharge flow path 311 and the internal space R. Also, as shown in FIG. 16B, the first core element 351 has an internal flow path 351R communicating with the dip tube 370 via the first passage R1 in the body 310. The internal flow path 351R has a step portion 351*d* in the horizontal flow path thereof, and communicates with the flow groove 311*n* provided in the body 310 via the flow hole 351*h*.

Figure 17A:
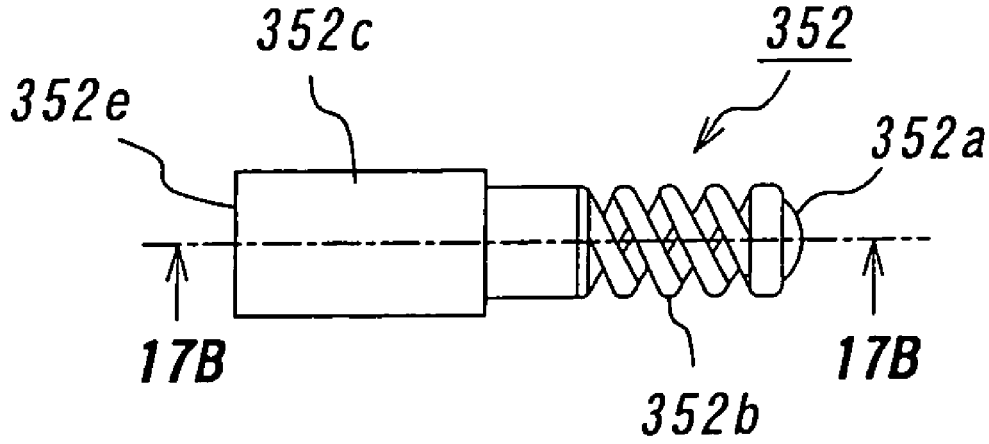
FIG. 17A is a plan view of a second core element of the trigger pump shown in FIG. 13.
Figure 17B:
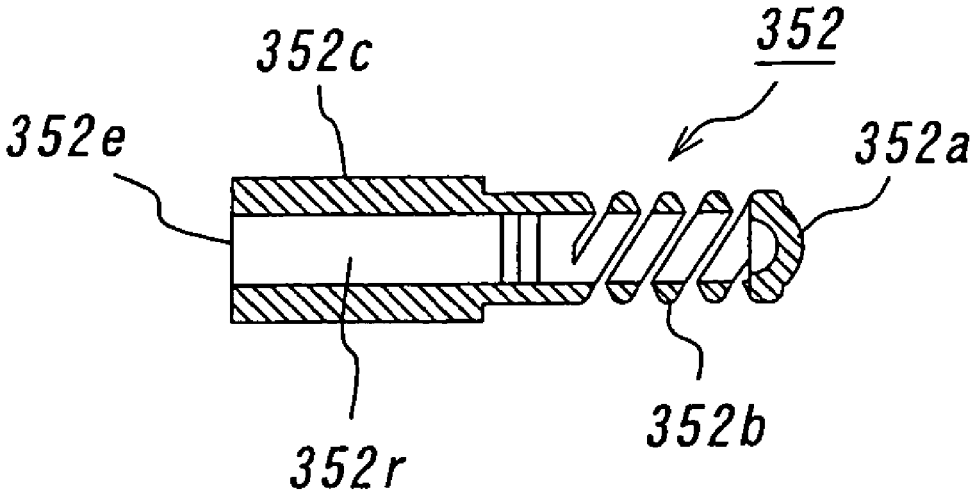
FIG. 17B is a sectional view taken along the line 17B-17B of FIG. 17A.

The second core element 352 shown in FIGS. 17A and 17B is inserted in the discharge flow path 311 in the body 310, and includes a valve element 352*a* for closing the internal flow path 351R provided in the first core element 351 and a first hollow tube 352*c* for holding the valve element 352*a* via a spring 352*b*. A hollow portion of this first hollow tube 352*c* forms an internal flow path 352R. As shown in FIG. 13, the second core element 352 is assembled so that the valve element 352*a* is inserted in the internal flow path 351R provided in the first core element 351, and comes into contact with the step portion 351*d* provided in the internal flow path 351R.

Figure 18A:
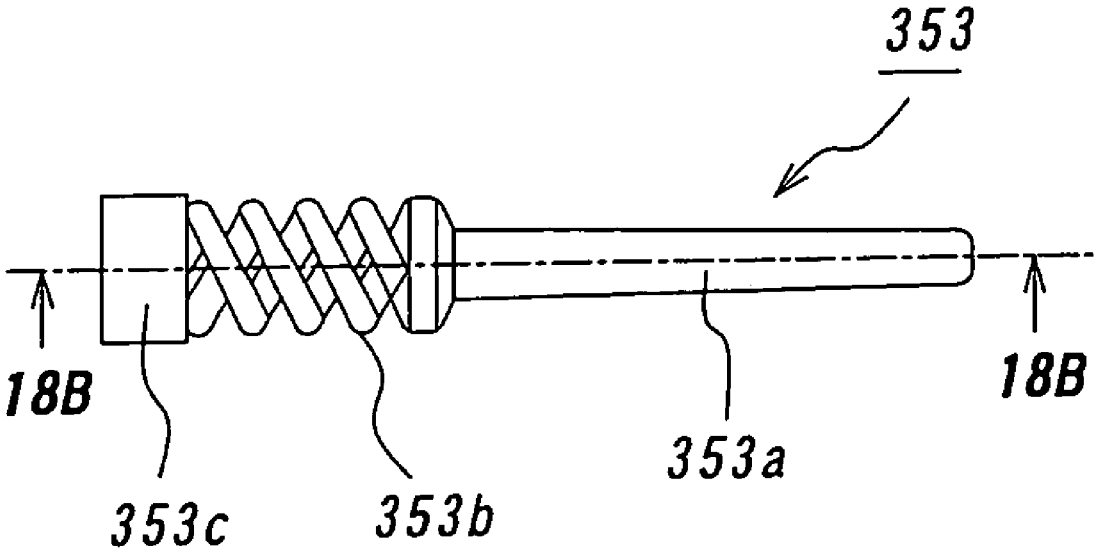
FIG. 18A is a plan view of a third core element of the trigger pump shown in FIG. 13.
Figure 18B:
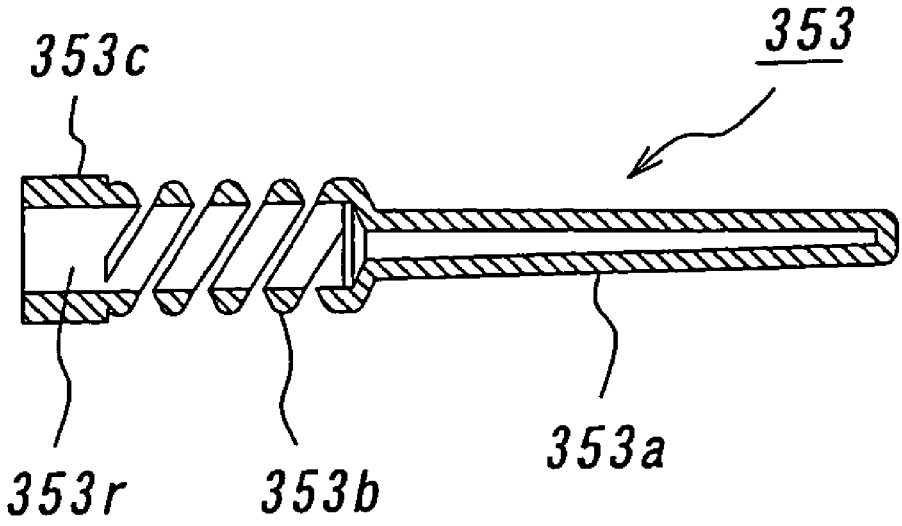
FIG. 18B is a sectional view taken along the line 18B-18B of FIG. 18A.

The third core element 353 shown in FIGS. 18A and 18B is inserted in the discharge flow path 311 in the body 310, and includes a valve element 353*a* for closing the internal flow path 352R provided in the first hollow tube 352*c* and a second hollow tube 353*c* for holding the valve element 353*a* via a spring 353*b*. A hollow portion of this second hollow tube 353*c* forms an internal flow path 353R. The third core element 353 is assembled so that the valve element 353*a* is inserted in the internal flow path 352R provided in the first hollow tube 352*c*, and comes into contact with a discharge port 352*e* of this internal flow path 352R.

In a state in which the above-described three core elements 351 to 353 are inserted in the discharge flow path 311 and the internal space R, the valve element 352*a* closes a seat portion 351*d* formed by the step portion by means of the urging force of the spring 352*b*, and the valve element 353*a* closes the discharge port 352*e* of the internal flow path 352R by means of the urging force of the spring 353*b*, by which the enclosed space R1 is defined. Therefore, when the piston 140 is pushed into the cylinder 312 to pressurize the enclosed space R1 from the second passage R2 via the flow groove 311*n* and the flow hole 351*h*, the valve element 353*a* separates from a seat portion 352*d* against the urging force of the spring 353*b*, by which the enclosed space R1 is opened to the outside from the discharge flow path 311. On the other hand, when the piston 140 is pulled back in the cylinder 312 to decompress the enclosed space R1 from the second passage R2 via the flow groove 311*n* and the flow hole 351*h*, the valve element 352*a* separates from the seat portion 352*d* against the urging force of the spring 352*b*, by which the enclosed space R1 is opened.

Specifically, the first hollow tube 352*c* and the third core element 353 form a discharge valve that is opened by the push-in action of the piston 140 brought about in cooperation with the pulling operation of the trigger 130 to discharge the fluid in the discharge flow path 311 to the outside. On the other hand, the first core element 351 and the second core element 352 form a suction valve that is opened by the push-back action of the piston 140 brought about in cooperation with the return of the trigger 330 caused by the urging force of the elastic portion 132 to suck a fluid into the discharge flow path 311.

Next, the operation of the vessel 400 fitted with the trigger pump 300 in accordance with the third embodiment will be described in detail.

As shown in FIG. 13, first, the user pulls the hook portion 131 of the trigger 130 in the direction of arrow d, by which the piston 140 is pushed into the cylinder 312 against the urging force of the elastic portion 132 of the trigger 130 in cooperation with the pulling operation of the trigger 131 to pressurize the interior of the enclosed space R1. At this time, the tip end 132*e* of the extension portion of the elastic member 132 presses the hook portion 131, and on the other hand, the bent portion 132*a* extends, and at the same time, the wavy portion 132*b* contracts. As a result, the pressure in the enclosed space R1 increases. Therefore, the valve element 353*a* of the third core element 353 is separated from the seat portion 352*e* of the second core element against the urging force of the spring 353*b* while the valve element 352*a* of the second core element 352 is kept seated. After the air in the enclosed space R1 is discharged from the internal flow path 353R of the second hollow tube 353*c* and the discharge flow path 311 to the nozzle 160, the valve element 353*a* of the third core element 353 is seated again on the seat portion 352*e* by the urging force of the spring 353*b*. Subsequently, when the user removes his/her hand from the trigger 130, the bent portion 132*a* contracts, and at the same time, the wavy portion 132*b* extends and is restored. Therefore, the piston 140 is pushed back via the trigger 130 by the urging force of the elastic portion 132, by which a negative pressure is produced in the enclosed space R1. Thus, the valve element 352*a* of the second core element 352 separates from the seat portion 351*d* of the first core element 351 against the urging force of the spring 352*b* while the valve element 353*a* of the third core element 353 is seated, and hence the content in the container body 410 is sucked via the dip tube 170 and the first passage R1 and is introduced into the enclosed space R1.

Subsequently, the user repeats the pulling operation of the trigger 130. Thereby, the pressure of content filled in the enclosed space R1 is increased and decreased, so that the valve element 353*a* of the third core element and the valve element 352*a* of the second core element are opened and closed alternately. As a result, the content in the container body 400 is sucked up, and the sucked content passes through the discharge flow path 311 and is spun at the discharge port 311*a* and the nozzle 160, by which the content is sprayed from the opening 160*a* of the nozzle 160.

Whereas the conventional trigger pump consists of 12 parts of a body, trigger, piston, return spring, discharge valve, suction valve, intake, dip tube, sealing member, cap, spin element, and nozzle, the trigger pump 300 of the third embodiment consists merely of nine parts of the body 310, cover 320, trigger 330, piston 340, first core element 350, second core element 352, third core element 353, nozzle 360, and dip tube 370.

In addition, according to the trigger pump 300 in accordance with the third embodiment, the valve element 352*a* closes the seat portion 351*d* so as to be opened and closed freely by means of the urging force of the spring 352*b*, and the valve element 353*a* closes the seat portion 352*e* so as to be opened and closed freely by means of the urging force of the spring 353*b*. Therefore, the discharge quantity of the trigger pump 300 can be changed appropriately by regulating the springs 352*b* and 353*b*.

Although the preferred embodiments of the present invention have been described above, it is a matter of course that the present invention can be carried out in many modes without departing from the scope specified in the claims. For example, the trigger may be held by the cover, not by the body, so as to be swingable. Similarly, the turned-down portion of the elastic portion provided integrally with the hook portion may also be held by the cover, not by the internal wall of body. In addition, the trigger pump may use the conventional cap and spin element, and further may be of a type such as to directly discharge the content such as a milky lotion without using the spin element.

The invention claimed is:

1. A trigger type fluid dispenser comprising:

a body which is provided with a discharge flow path for discharging a fluid in a horizontal direction and has a cylinder disposed in parallel with said discharge flow path;

a trigger held to be swingable with respect to said body; and a piston which slides reciprocatively in said cylinder in cooperation with said trigger, wherein said trigger includes a hook portion which is held to be swingable with respect to said body, and an elastic portion in which two extension portions integrally extending from a swinging portion of said hook portion are turned down, the turned-down portions are held with respect to said body, and tip ends of said extension portions are positioned to be capable of coming into contact with said hook portion, wherein said elastic portion is configured so that on one side of said turned-down portions of said extension portions, bent portions in which said extension portions are bent at least in one place are provided, and on the other side thereof, wavy portions in which said extension portions are bent at a plurality of places are provided, and wherein said tip ends of said extension portions are in direct contact with at least one beam extending from said swinging portion to provide a predetermined clearance from said hook portion, the at least one beam and at least one of the extension portions being a single continuous component.

2. The trigger type fluid dispenser according to claim 1, wherein said trigger type fluid dispenser further comprises a cover which is installed to said body to form an internal space between said cover and said discharge flow path, and the turned-down portion of said trigger is held by said body or cover.

3. The trigger type fluid dispenser according to claim 1, wherein said trigger type fluid dispenser further comprises a discharge valve which is opened by the push-in action of said piston to discharge a fluid in said discharge flow path to the outside, and a suction valve which is opened by the push-back action of said piston to suck a fluid into said discharge flow path.

4. The trigger type fluid dispenser according to claim 3, wherein said discharge valve and said suction valve are tongue-shaped elements integrally provided on a core element which is inserted in said discharge flow path and said internal space to form a flow path between said discharge flow path and said internal space, and said discharge valve is located near a discharge port of said discharge flow path and said suction valve is located in said internal space.

5. The trigger type fluid dispenser according to claim 3, wherein said discharge valve and said suction valve are tongue-shaped elements integrally provided on a core element which is inserted in said discharge flow path and said internal space to form a flow path between said discharge flow path and said internal space, and said discharge valve and said suction valve are located in said internal space.

6. The trigger type fluid dispenser according to claim 1, wherein said body integrally includes a spin element near the discharge port of said discharge flow path.

7. The trigger type fluid dispenser according to claim 1, wherein said body integrally includes a connecting portion for connecting said body to a mouth of a container body.

8. The trigger type fluid dispenser according to claim 1, wherein said trigger is arranged so that said elastic portion is located on almost the same level as said discharge flow path.

9. The trigger type fluid dispenser according to claim 1, wherein either one of said trigger and said piston has a holding pin and the other has an opening having a diameter larger than that of said holding pin, and by inserting said holding pin in said opening, said trigger and said piston are operated in cooperation with each other.

10. A trigger type fluid dispenser comprising:

a body which is provided with a discharge flow path for discharging a fluid in a horizontal direction and has a cylinder disposed in parallel with said discharge flow path;

a trigger held to be swingable with respect to said body;

a piston which slides reciprocatively in said cylinder in cooperation with said trigger; and a discharge valve which is opened by the push-in action of said piston to discharge a fluid in said discharge flow path to the outside, and a suction valve which is opened by a push-back action of said piston to suck a fluid into said discharge flow path, wherein said trigger includes a hook portion which is held to be swingable with respect to said body, and an elastic portion in which two extension portions integrally extending from a swinging portion of said hook portion are turned down, the turned-down portions are held with respect to said body, and the tip ends of said extension portions are positioned to be capable of coming into contact with said hook portion, and said suction valve includes a first core element which is inserted in said internal space or in said internal space and discharge flow path and has an internal flow path, and a second core element which is inserted in said discharge flow path and has a valve element which closes said internal flow path and a first hollow tube for holding said valve element to be capable of opening and closing said valve element via a spring, and said discharge valve includes a third core element which is inserted in said first hollow tube and said discharge flow path and has a valve element which closes said first hollow tube and a second hollow tube for holding said valve element to be capable of opening and closing said valve element via a spring.

11. The trigger type fluid dispenser according to claim 10, wherein said tip ends of said extension portions are supported by at least one beam extending from said swinging portion to provide a predetermined clearance from said hook portion.

* * * * *